US005979373A

United States Patent [19]

Sano

[11] Patent Number: 5,979,373

[45] Date of Patent: Nov. 9, 1999

[54] COOLING CONTROL SYSTEM FOR AN INTERNAL COMBUSTION ENGINE

[75] Inventor: Mitsuhiro Sano, Kiyose, Japan

[73] Assignee: Nippon Thermostat Co., Ltd., Tokyo, Japan

[21] Appl. No.: 09/131,404

[22] Filed: Aug. 10, 1998

[51] Int. Cl.[6] ..... F01P 7/14; F01P 5/14

[52] U.S. Cl. ..... 123/41.1; 123/41.08; 123/41.15; 236/34.5; 236/DIG. 2

[58] Field of Search ..... 123/41.08, 41.1, 123/41.15, 396; 236/34.5, 101 C, DIG. 2

[56] References Cited

U.S. PATENT DOCUMENTS

| | | | |
|---|---|---|---|
| 2,176,331 | 10/1939 | Drapeau | 123/41.1 |
| 4,848,652 | 7/1989 | Kennedy | 236/34.5 |
| 4,895,301 | 1/1990 | Kennedy | 236/34.5 |
| 5,111,775 | 5/1992 | Sumida et al. | 123/41.1 |
| 5,361,980 | 11/1994 | Stout | 236/34.5 |
| 5,582,138 | 12/1996 | Ziolek et al. | 123/41.1 |

FOREIGN PATENT DOCUMENTS

| | | |
|---|---|---|
| 41 09 498 | 9/1992 | Germany . |
| 10-317966 | 12/1998 | Japan . |
| 11-22465 | 1/1999 | Japan . |

*Primary Examiner*—Willis R. Wolfe
*Assistant Examiner*—Brian Hairston
*Attorney, Agent, or Firm*—Oblon, Spivak, McClelland, Maier & Neaustadt, P.C.

[57] ABSTRACT

A cooling control system by which an internal combustion engine is prevented from overheating, and a fail-safe function exerts its effect. A butterfly valve 34*b* for regulating the flow of cooling water is rotated by a motor 31, a clutch mechanism 32, and a speed reduction mechanism 33, thereby cooling the engine to be at the most suitable temperature for driving. The aforesaid butterfly valve 34*b* is given momentum in a direction to open the valve 34*b* by a return spring 34*e*. For example, an angle sensor 34*g* for detecting the rotational angle of the butterfly valve 34*b* is included. In a computing unit, when it is determined that an abnormality occurs from the relationship between the data from an encode 34*g* and the temperature of the cooling water, the clutch mechanism 32 is released, and the butterfly valve 34*b* is automatically opened. Accordingly the engine is prevented form overheating.

9 Claims, 9 Drawing Sheets

COOLING CONTROL SYSTEM FOR AN INTERNAL COMBUSTION ENGINE

BACKGROUND OF THE INVENTION

1. Field of the Invention

The present invention relates to a cooling control system for cooling an internal combustion engine such as an engine for an automobile, and particularly to a cooling control system for an internal combustion engine, which can prevent the engine from overheating in the event that a failure occurs in a control system controlling the flow of a cooling medium, or the like.

2. Description of the Related Art

In an internal combustion engine (hereinafter referred to as an engine) which is used for an automobile or the like, a water cooling type of cooling apparatus using a radiator is generally used for cooling the engine.

In this type of cooling apparatus, a thermostat for controlling the temperature of cooling water is used, and when the temperature of the cooling water is lower than a specified temperature, the cooling water is passed through a bypass conduit and is circulated without passing through a radiator under the control of the aforesaid thermostat.

FIG. 8 illustrates the configuration, and a numeral 1 represents an engine composed of a cylinder block 1*a* and a cylinder head 1*b*. Fluid conduits shown by arrows c are formed in the cylinder block 1*a* and the cylinder head 1*b* of the engine 1.

A numeral 2 represents a heat exchanger, that is, a radiator, and a fluid conduit 2*c* is formed in the radiator 2 as is known. A cooling-water inlet portion 2*a* and a cooling-water outlet portion 2*b* of the radiator 2 are connected to a cooling-water conduit 3 for circulating cooling water between the aforesaid engine 1 and the radiator 2.

The cooling-water conduit 3 is composed of an outflow-side cooling-water conduit 3*a*, which is communicated with a cooling-water outflow portion 1*d* provided at the upper portion of the engine 1 and the cooling-water inflow portion 2*a* provided at the upper portion of the radiator 2, an inflow-side cooling-water conduit 3*b*, which is communicated with the cooling-water outflow portion 2*b* provided at the lower portion of the radiator 2 and a cooling-water inflow portion 1*e* provided at the lower portion of the engine 1, and a bypass conduit 3*c* connecting the portion between both of the coolingwater conduits 3*a* and 3*b*.

A thermostat 4 is disposed at the portion branching into the outflow-side cooling-water conduit 3*a* and the bypass conduit 3*c* in the cooling-water conduit 3. The thermostat 4 incorporates a thermal expansive body (for example, wax) which expands or shrinks depending on a change in the temperature of the cooling water. The thermostat 4 has the following operation: when the temperature of the cooling water is higher (for example, more than 80° C.), the thermostat 4 opens a valve by the expansion of the aforesaid thermal expansive body, and allows the cooling water flowing out of the outflow portion 1*d* of the engine 1 to enter the radiator through the outflow-side cooling-water conduit 3*a*, then allowing the cooling water, having lower temperature as a result of the heat radiation conducted in the radiator 2, to flow out of the outflow portion 2*b* to pass through the inflow-side cooling-water conduit 3*b* and to flow into the engine 1 from the inflow portion 1*e* of the engine 1.

When the temperature of the cooling water is lower, the valve of the thermostat 4 is closed as a result of the thermal expansion body shrinking, and the cooling water flowing out of the outflow portion 1*d* of the engine 1 is designed to pass through the bypass conduit 3*a* and to flow into the cooling conduit c in the engine 1 from the inflow portion 1*e* of the engine 1.

It should be mentioned that a numeral 5 in FIG. 8 represents a water pump disposed at the inflow portion 1*e* of the engine 1, which compulsorily circulates the cooling water, with its rotational shaft being rotated by the rotation of a crankshaft, not illustrated, of the engine 1. A numeral 6 is a fan unit for compulsorily taking cooling air into the radiator 2, and the fan unit 6 is composed of a cooling fan 6*a* and a fan motor 6*b* for rotationally driving the cooling fan 6*a*.

The valve opening and closing operations by the thermostat as described above is determined by the temperature of the cooling water, and the operation is made as a result of the expanding or the shrinking action of the thermal expansive body such as wax, therefore the temperatures for opening and closing the valve are not fixed. Specifically, it takes some time for the thermal expansive body such as wax to operate the valve after the thermal expansive body is given a change in the temperature of the cooling water. The responsiveness to a decrease in temperature is especially worse compared to that to an increase in temperature, and has so-called hysteresis properties. For this reason, there is a technical disadvantage of extreme difficulty in regulating cooling water at a desired fixed temperature.

Hence, an apparatus for electrically controlling the flow of cooling water without utilizing the expansion of a thermal expansive body such as wax for opening and closing operations of a valve is proposed.

The apparatus controls the rotational angle of a butterfly valve by means of a motor. The thermostat 4 in FIG. 8 is omitted, and a valve unit 7 is disposed at the outflow-side cooling-water conduit 3*a* equipped with the butterfly valve instead of the thermostat 4 as shown by a broken line in FIG. 8.

FIG. 9 shows an example of the valve unit 7, and a butterfly valve 7*a* in a circular flat plate shape is rotatably supported by a shaft 7*b* inside the cooling-water conduit 3*a*. A worm wheel 7*c* is attached at one end of the shaft 7*b*, and a worm 7*e* fitted in the rotational driving shaft of a motor 7*d* is meshed with the aforesaid worm wheel 7*c*.

The aforesaid motor 7*d* is supplied with operating current, which normally rotates and reverses the driving shaft thereof, by a control unit (ECU) controlling the driving state of the entire engine. Accordingly, when the current for normally rotating the driving shaft is supplied to the motor 7*d* by the operation of the ECU, the shaft 7*b* of the butterfly valve 7*a* is rotated in one direction by the known deceleration action of the worm 7*e* and the worm wheel 7*c*, thereby the butterfly valve 7*a* is rotated so that the face thereof is in the same direction as the flowing direction of the cooling-water conduit 3*a* to establish a valve opened position.

When the current for reversing the driving shaft is supplied to the motor 7*d* by the operation of the ECU, the shaft 7*b* of the butterfly valve 7*a* is rotated in another direction, thereby the butterfly valve 7*a* is rotated so that the face thereof is in a direction perpendicular to the direction of the cooling-water conduit 3*a* to establish a valve closed position.

The aforesaid ECU is supplied with information regarding, for example, the temperature of the cooling water of an engine, and the temperature of the cooling water can be controlled by controlling the aforesaid motor by utilizing the information.

However, in the cooling control system using the aforesaid butterfly valve, the opening and closing operations of the butterfly valve can't be made in a case where, for example, a breakdown occurs in the motor, or a failure occurs in the worm gear portion.

When the aforesaid breakdown or failure occurs, for example, when the butterfly valve is in the valve closed position, or in a valve-partially-opened position, sufficient cooling operation of the engine is not carried out, and therefore there is a technical disadvantage of the engine overheating while a driver does not notice that.

In order to avoid the above disadvantage, a mechanism directly driving the butterfly valve without using the aforesaid worm gear is conceivable, and it is further conceivable to provide a return spring for giving the momentum to drive the butterfly valve to the valve opened position. In this configuration, the butterfly valve can be automatically opened by the momentum given by the return spring even when a failure occurs, thereby preventing the engine from overheating.

However, when driving a butterfly valve, 0.5 Kg·cm is needed as a friction of the butterfly valve, 2.0 Kg·cm is needed as torque of the valve against the water pressure of cooling water, and 2.5 Kg·cm is needed as torque against the return spring.

Accordingly, in order to drive the butterfly valve, torque of more than 5.0 Kg·cm is needed. Consequently, an actuator such as a motor or linear solenoid for giving the above driving force is inevitably larger in size, therefore there is a disadvantage of a greater volume it constitutes.

In addition, the aforesaid configuration, in which the butterfly valve is directly driven by the actuator, employs a driving method for balancing the valve opening position with the momentum given by the return spring and the driving force from the actuator driving the butterfly valve when holding the butterfly valve at a certain fixed rotational angle, therefore there is a disadvantage of a necessity arising to always supply driving current to the aforesaid actuator.

SUMMARY OF THE INVENTION

The present invention is made to eliminate the technical disadvantages described above, and its object is to provide a cooling apparatus which prevents problems such as overheating of an engine as a result of a failure occurring to a driving device portion or the like, for example, of a flow control valve, and which can perform a fail-safe function.

The cooling control system for an internal combustion engine according to the present invention which is provided in order to eliminate the aforesaid disadvantages is a cooling control system for an internal combustion engine having a configuration in which a circulating passage for a cooling medium is formed between a fluid conduit formed in an internal combustion engine and a fluid conduit formed at a heat exchanger, and in which heat produced in the internal combustion engine is radiated by the aforesaid heat exchanger by circulating the cooling medium in the aforesaid circulating passage, and includes a control unit for producing a control signal in response to a detection signal from at least one detecting sensor for detecting the driving condition of the internal combustion engine, a motor rotationally driven based on a control signal from the aforesaid control unit, a speed reduction mechanism for reducing the rotational speed of the aforesaid motor, a flow control valve which is opened and closed by the rotational driving force obtained from the aforesaid speed reduction mechanism, and which controls the flow of the cooling medium in the circulating passage between the aforesaid internal combustion engine and the aforesaid heat exchanger, a return spring for giving momentum to the aforesaid flow control valve in a valve opening direction, and a clutch mechanism for releasing the coupling of the control valve driving system from the aforesaid motor and the aforesaid flow control valve when obtaining the output of the detection of an abnormality in the aforesaid internal combustion engine.

According to the above configuration, when an abnormality occurs to the engine, the clutch mechanism is released, and the flow control valve is automatically driven to a valve opened position by the action of the return spring.

In this case, the aforesaid flow control valve is composed of a butterfly valve in a flat plate form, which is disposed in the cylindrical passage for the cooling medium, and the angle of which flat surface varies in relation to the direction in which the cooling medium flows. By using such a butterfly valve, a valve opened and a valve closed positions are established in the range of a rotational angle of about 90 degrees, and therefore flow control by the medium of the speed reduction mechanism, and a valve opening operation by the return spring when an abnormality occurs are smoothly carried out.

Further, the aforesaid clutch mechanism is desired to be disposed between a rotational shaft of the aforesaid motor and the aforesaid speed reduction mechanism. According to the configuration, a driving force applied to the clutch mechanism, specifically, torque can be reduced, and the clutch mechanism is prevented from slipping, and being worn, and the size of the clutch mechanism can be reduced.

The aforesaid abnormality detection output is generated based on the temperature of the cooling medium, and a target preset temperature stored in the aforesaid control unit. Accordingly, the difference between the actual temperature of the cooling medium and the target preset temperature is computed, and if the actual temperature is out of a predetermined temperature range after a certain fixed time has passed, the aforesaid control unit can determine that the aforesaid control valve is producing trouble.

Further, the aforesaid abnormality detection output is generated based on the relationship between the temperature of the cooling medium and the rotational angle of the flow control valve. In this case, in a preferable embodiment, the rotational angle of the aforesaid flow control valve is obtained from an angle sensor coupled to a shaft supporting the aforesaid flow control valve.

According to the configuration, the angle sensor always monitors the angle of the flow control valve, specifically, the butterfly valve, therefore the occurrence of an abnormality is determined when the angle is different from the output produced from the control unit, and accurate information about the rotational angle of the control valve is obtained though the size of the apparatus is small.

Furthermore, when driving the aforesaid flow control valve in a direction to a valve closed position, the driving torque produced by the aforesaid motor is controlled to be greater compared to the driving torque produced by the aforesaid motor when driving the aforesaid flow control valve in a direction to a valve opened position.

In this case, in a preferable embodiment, the aforesaid motor is a DC motor, a bridge circuit is composed of first and second switching elements connected in series between a positive terminal and a negative terminal of a power source, and third and fourth switching elements connected in series between the positive terminal and the negative terminal, a pair of driving current input terminals of the aforesaid DC motor are respectively connected between a junction of the aforesaid first and second switching elements and a junction of the aforesaid third and fourth switching elements, and a pulse width added to a control electrode terminal of the aforesaid first and fourth switching elements has a pulse width different from that added to a control electrode terminal of the aforesaid second and third switching elements.

In this configuration, in the bridge circuit composed of the switching elements, the control of the normal and reverse rotations of the DC motor is conducted, and a torque characteristic is controlled by width the pulse width given to the control terminals of the switching elements.

It is preferable to further include a heat responsive member which expands and shrinks depending on the temperature of the cooling medium to compose a cutoff mechanism for releasing the coupling of the shaft for supporting the aforesaid flow control valve and the aforesaid speed reduction mechanism by the expanding action of the aforesaid heat responsive member, so that the aforesaid cutoff mechanism allows the flow control valve to be in a valve opened position by means of the aforesaid return spring.

Accordingly when an abnormality occurs, which cannot be avoided even by releasing the aforesaid clutch mechanism, the cutoff mechanism composed of the heat responsive member is eventually operated, and thereby opening the flow control valve, therefore the fail-safe function is further reinforced.

DETAILED DESCRIPTION OF THE PREFERRED EMBODIMENTS

A preferable embodiment of a cooling control system for an internal combustion engine according to the present invention will be explained based on the drawings.

Figure 1:
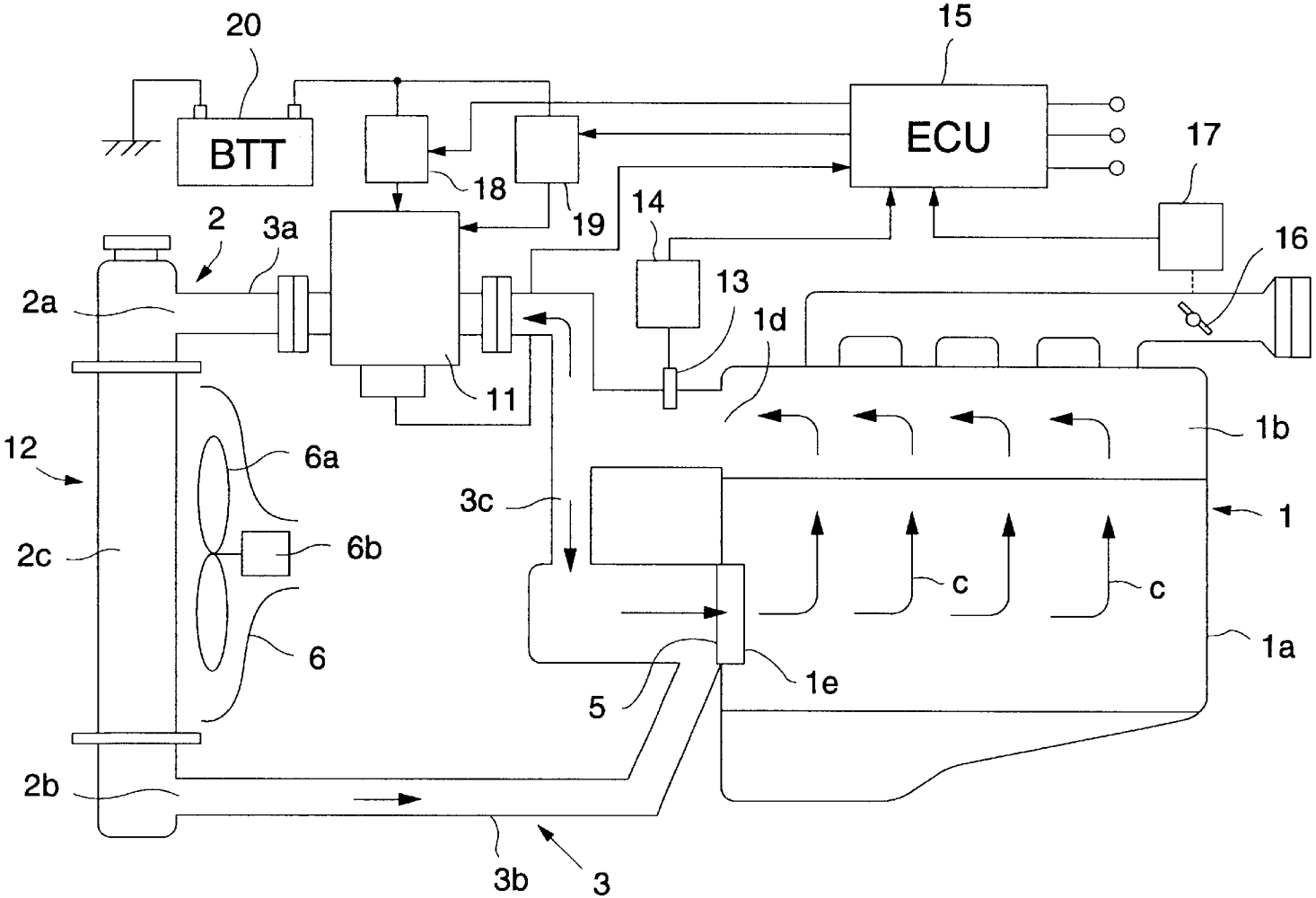
FIG. 1 is a block diagram showing an embodiment in a cooling control system according to the present invention.
Figure 8:
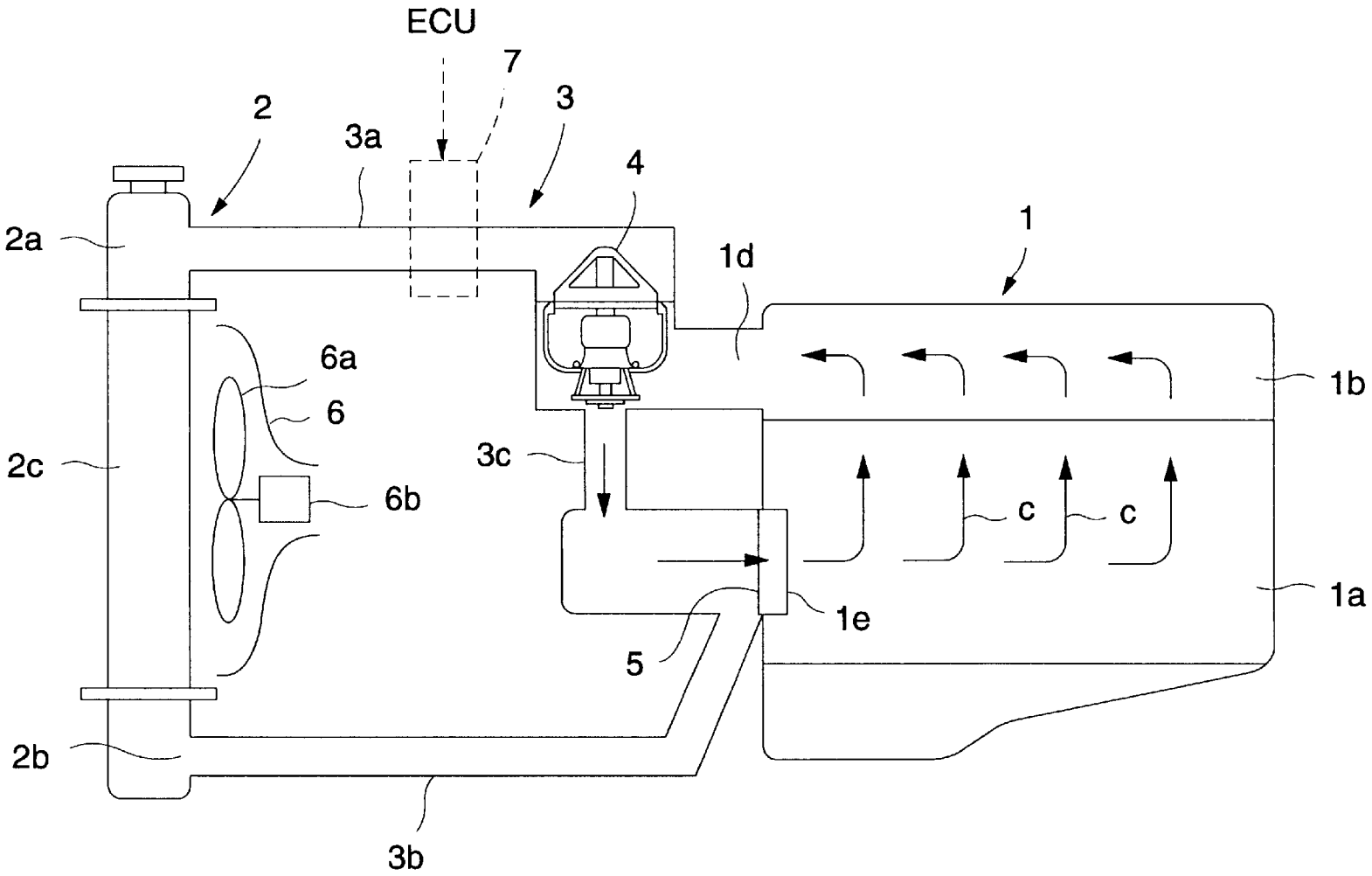
FIG. 8 is a block diagram showing an example of the conventional cooling control system.
Figure 9:
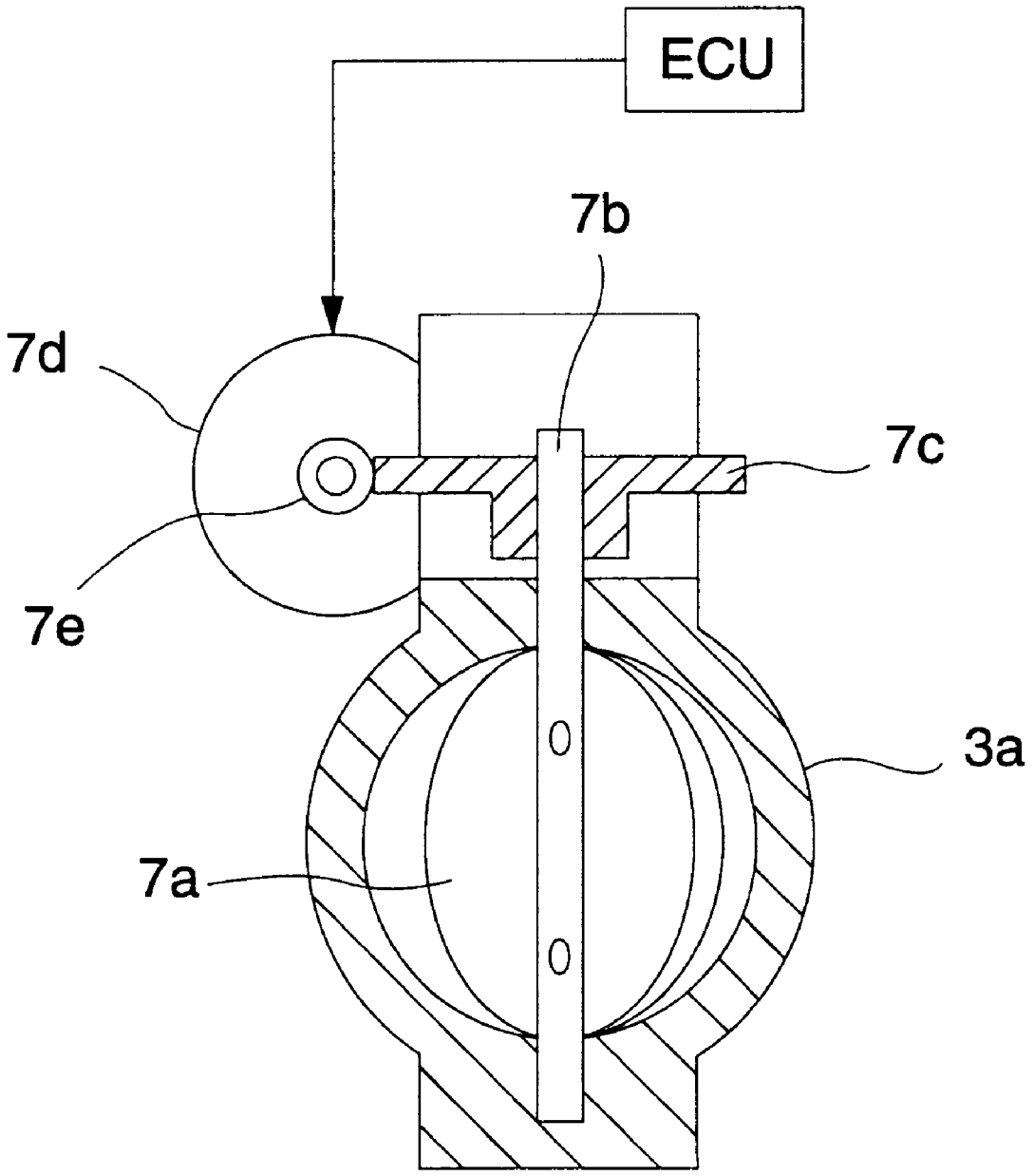
FIG. 9 is a block diagram showing an example of the conventional flow control device by a butterfly valve in a partially sectional state.

FIG. 1 shows a general configuration of the cooling control system applied to an automobile engine. In FIG. 1, components having the same numerals as in the conventional apparatus shown in FIG. 8 are the same components in FIG. 8, therefore the explanation of the individual structures and operations are omitted as necessary.

As shown in FIG. 1, a flow control unit 11 is connected by means of flanges to an outflow-side cooling-water conduit 3*a* disposed between a cooling-water outflow portion 1*d* provided at the upper portion of an engine 1 as an internal combustion engine, and a cooling-water inflow portion 2*a* provided at the upper portion of a radiator 2 as a heat exchanger.

Thereby a circulating passage 12 for a cooling medium, specifically, cooling water is formed in the form including the flow control unit 11.

A temperature detecting element 13 such as, for example, a thermistor is disposed at the outflow portion 1*d* for the cooling water in the aforesaid engine 1. The value detected by this temperature detecting element 13 is converted by a converter 14 into data which can be recognized by a control unit (ECU) 15, and the value is supplied to the control unit (ECU) 15 controlling the driving state of the entire engine.

In the embodiment shown in FIG. 1, data from a throttle position sensor 17 for detecting the degree of opening of a throttle valve 16 of the engine 1 is also supplied to the control unit 15. Though not shown in the drawing, information such as engine speed or the like is also supplied to the aforementioned control unit 15.

Meanwhile, a control signal is supplied to a motor control circuit 18 and a clutch control circuit 19 from the control unit 15. The motor control circuit 18 and the clutch control circuit 19 respectively control the current supplied from a battery 20, so that control current is supplied to a DC motor control circuit and a clutch control circuit described below, which is provided in the flow control unit 11.

Figure 2:
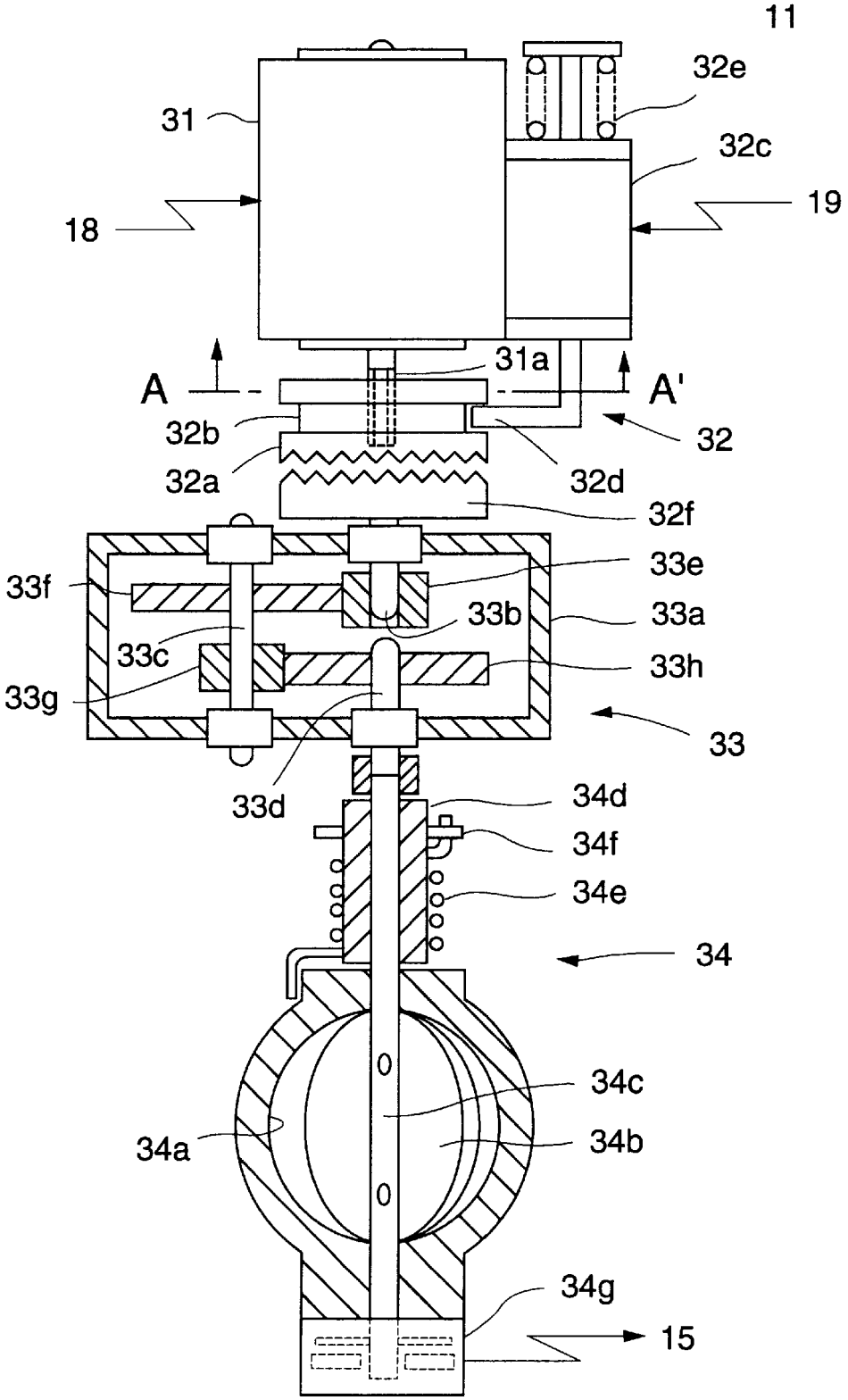
FIG. 2 is a block diagram showing a flow control unit in a partially sectional state, which is used in the apparatus in FIG. 1.

FIG. 2 schematically shows the configuration of the aforesaid flow control unit 11, and part of the unit is shown in a sectional form. The flow control unit 11 is equipped with a DC motor 31, and a first clutch disc 32*a* composing a clutch mechanism 32 is coupled to a rotational shaft 31*a* of the DC motor 31 in a rotational direction of the rotational shaft 31*a*, and is attached thereto to be slidable in the axial direction.

Figure 3:
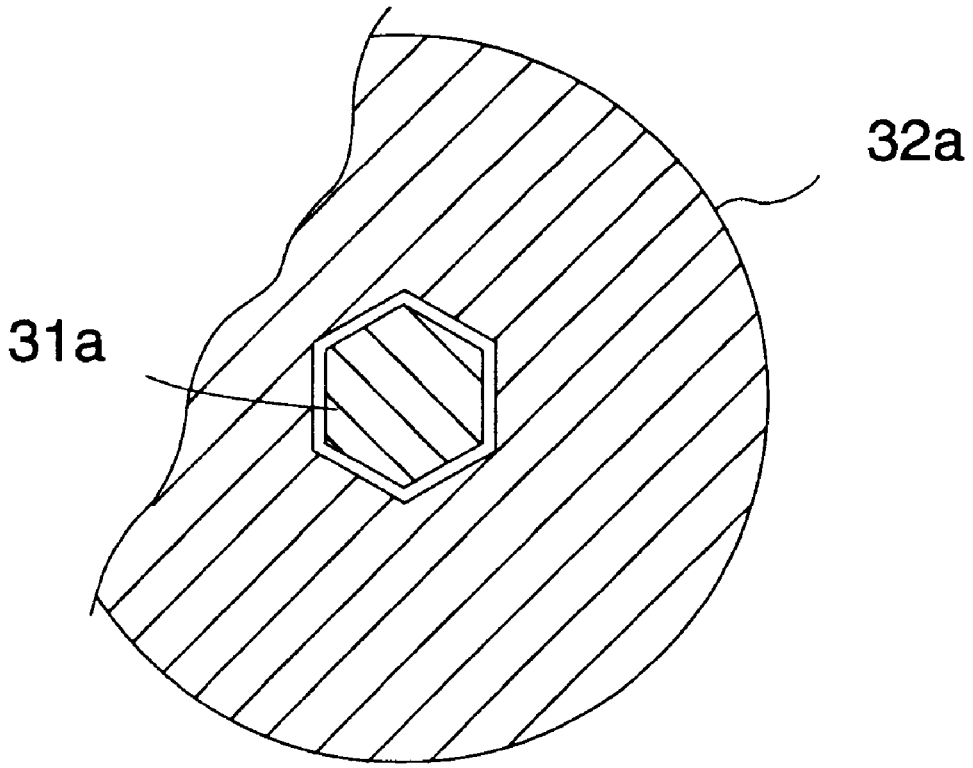
FIG. 3 is an enlarged sectional view taken along the A–A' line in FIG. 2.

FIG. 3 shows the state in which the A to A' portion in FIG. 2 is seen in an arrow direction. Specifically, the rotational shaft 31*a* of the aforesaid motor has its outer appearance formed in a hexagon as shown in the drawing, while at the central portion of the first clutch disc 32*a*, a hexagonal hole is formed so as to surround the rotational shaft 31*a* of the aforesaid motor 31.

According to the configuration, the first clutch disc 32*a* is coupled to the rotational shaft 31*a* in a rotational direction thereof, and operates so as to be slidable in the axial direction.

Returning to FIG. 2, a ring-shaped gutter portion 32*b* is formed on the circumferential side surface of the aforesaid first clutch disc 32*a*, and the foremost end portion of a working portion 32*d* of an electromagnetic plunger 32*c* is loose fitted in this gutter portion 32*b*. A coil spring 32*e* is attached to the plunger 32*c*, and in a normal condition in which electric power is not applied to the plunger 32*c*, the first clutch disc 32*a* is retracted to the motor 31 side by the expansively opening action of the coil spring 32*e*.

A second clutch disc 32*f* is disposed so as to oppose the aforesaid first clutch disc 32*a*, and this second clutch disc 32*f* is firmly fixed to an input-side rotational shaft 33*b* composing a speed reduction mechanism 33.

In the aforesaid speed reduction mechanism 33, the aforesaid input-side rotational shaft 33*b*, an transitional rotational shaft 33*c*, and an output-side rotational shaft 33*d* are disposed by means of respective bearings attached to a case 33*a* so that the input-side rotational shaft 33*b* and the transitional rotational shaft 33*c* are parallel to the output-side rotational shaft 33*d*.

A pinion 33*e* is firmly fixed to the input-side rotational shaft 33*b* so as to mesh with a spur gear 33*f* firmly fixed to the transitional rotational shaft 33*c*, while a pinion 33*g* firmly fixed to the transitional rotational shaft 33*c* is designed to mesh with a spur gear 33*h* firmly fixed to the output-side rotational shaft 33*d*.

The above configuration of the speed reduction mechanism 33 provides a reduction ratio of about 1/50.

The output-side rotational shaft 33*d* of the aforesaid speed reduction mechanism 33 is coupled to the driving shaft of a flow control valve 34. The flow control valve 34 is composed of a butterfly valve 34*b* in a flat plate form disposed in a cylindrical cooling medium sluice 34*a*. The angle of the flat surface of the butterfly valve 34*b* relative to the direction in which the cooling water flows is formed depending on the rotational angle of a shaft 34*c* as a driving shaft to control the flow of the cooling water. Specifically, a valve opened position is established when the angle of the flat surface relative to the direction in which the cooling water flows is in the vicinity of 0 degree, and a valve closed position is established when the angle of the flat surface relative to the direction in which the cooling water flows is in the vicinity of 90 degrees. The flow of the cooling water is controlled linearly by properly selecting an angle in the range between the above two angles.

A collar 34*d* is firmly fixed to the shaft 34*c* at the speed reduction mechanism 33 side in the aforesaid shaft 34*c*, and a return spring 34*e* in a coil form is wound around the periphery side surface of the collar 34 to be attached thereon. One end of the return spring 34*e* is engaged with a part of cylindrical body composing the cooling medium sluice 34*a* inside thereof while the other end of the return spring 34*e* is engaged with a projected portion 34*f* attached to a part of the collar 34*d*.

In this state, the aforesaid return spring 34*e* gives momentum to the butterfly valve 34*b* coupled to the shaft 34*c* so as to be in the valve opened position.

An angle sensor 34*g* is coupled to the other end portion of the aforesaid shaft 34*c* opposing to the speed reduction mechanism 33, thereby enabling to recognize the rotational angle of the butterfly valve 34*b*.

In the flow control unit 11 configured as in the above, the aforesaid DC motor 31 is designed to receive driving current from the motor control circuit 18 shown in FIG. 1, and the electromagnetic plunger 32*c* in the clutch mechanism 32 is designed to receive driving current from the clutch control circuit 19 shown in FIG. 1. Further the output of the data regarding the rotational angle of the butterfly valve by means of the angle sensor 34*g* is supplied to the control unit 15 shown in FIG. 1.

Accordingly, in the configuration shown in FIG. 2, when the electromagnetic plunger 32*c* is energized, the working portion 32*d* moves the first clutch disc 32*a* to the second clutch disc 32*f* side to establish a coupling state. When driving current is supplied to the DC motor 31, the rotational driving force of the motor 31 is reduced by the speed reduction mechanism, and rotates the butterfly valve 34*b* by the medium of the shaft 34*c*. By the rotation of the shaft 34*c*, the aforesaid angle sensor 34*g* feeds the data regarding the rotational angle back to the control unit 15.

Figure 4:
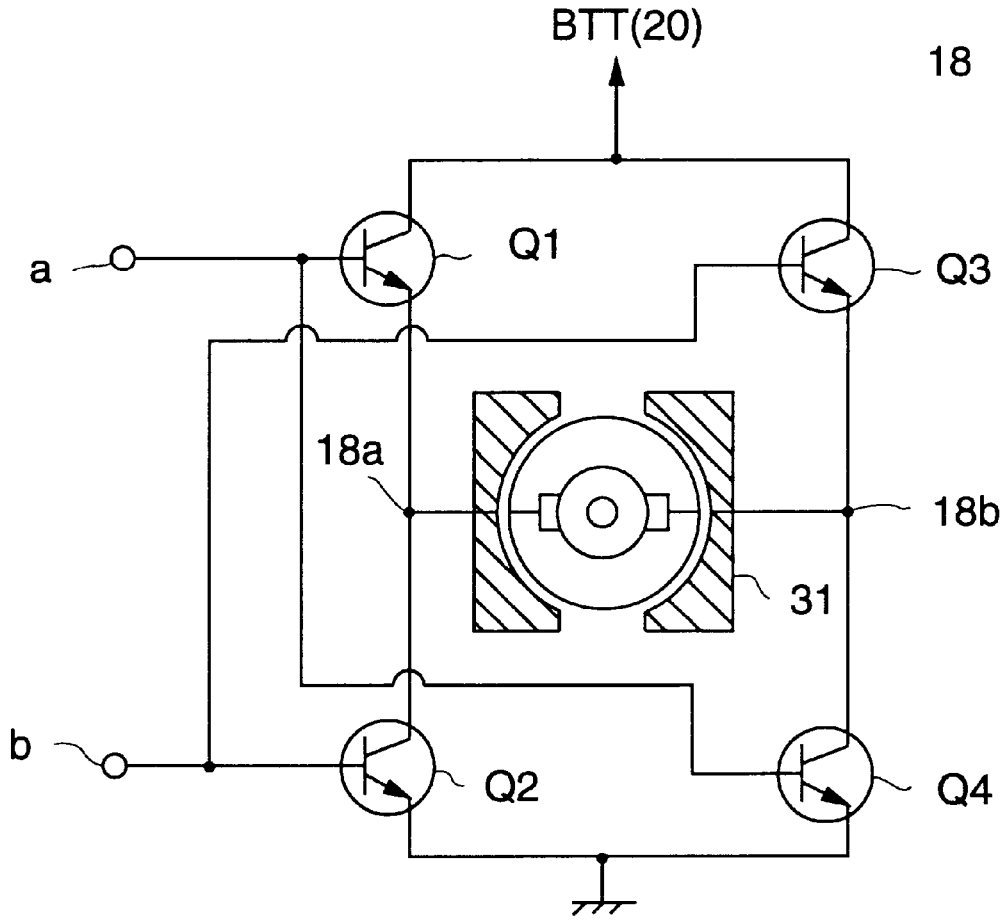
FIG. 4 is a connection diagram showing a motor driving circuit used in the apparatus shown in FIG. 1.

FIG. 4 is a connection diagram showing the configuration of the aforesaid motor control circuit 18. In the motor control circuit 18, a bridge circuit is composed of a first switching element Q1 and a second switching element Q2 connected in series between a positive terminal and a negative terminal (earth) of a power source (a battery 20), and a third switching element Q3 and a fourth switching element Q4 connected in series between the same positive terminal and negative terminal.

Each of these switching elements is composed of a NPN-type bipolar-transistor. Accordingly, each of collectors of the first and the third transistors Q1 and Q3 is connected to the positive terminal of the battery 20, and each of emitters of the second and the fourth transistors is connected to the earth.

The emitter of the first transistor Q1 and the collector of the second transistor Q3 are connected, and thereby composing a first junction 18*a*. The emitter of the third transistor Q3 and the collector of the fourth transistor Q4 are connected, and thereby composing a second junction 18*b*.

A pair of driving current input terminals of the DC motor 31 are respectively connected to the aforesaid junction 18*a* and the second junction 18*b* between them.

Control electrode terminals, specifically, bases of the first and the fourth transistors Q1 and Q4 are coupled to each other and compose an input terminal a, and bases of the second and the third transistors Q2 and Q3 are coupled to each other and compose an input terminal b.

Figure 5:
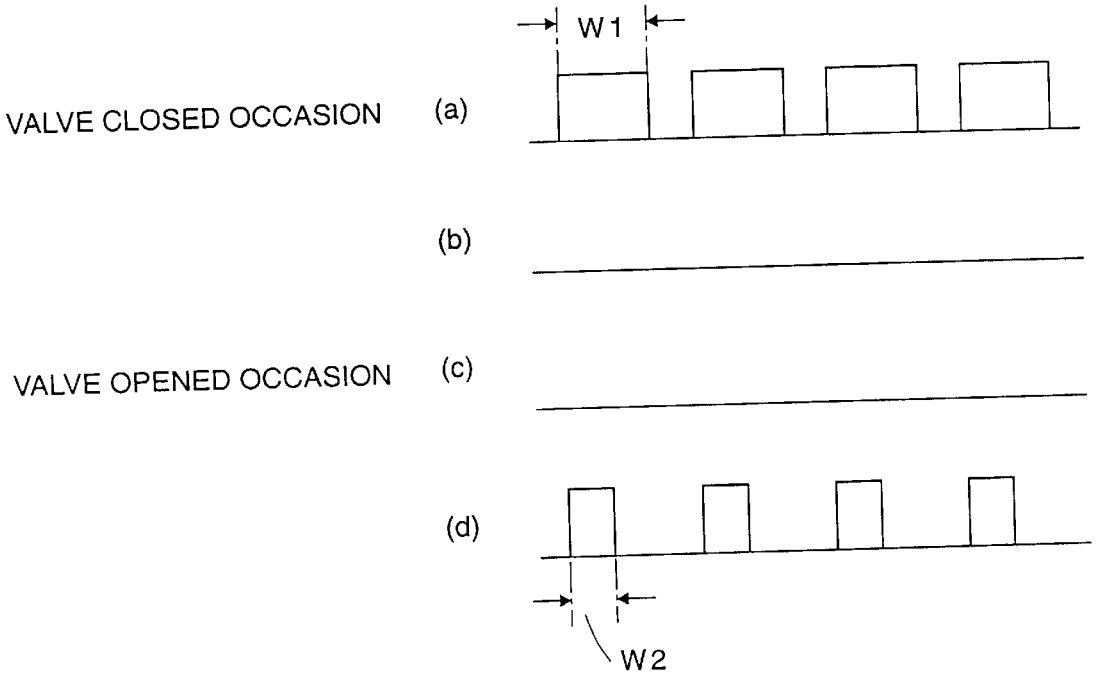
FIG. 5 is a wave form diagram showing an example of a control signal given to the motor driving circuit shown in FIG. 4.

FIG. 5 shows switch control signals given to the input terminal a and the input terminal b in FIG. 4 by the aforesaid control unit 15 in an alternative way.

The control signal is formed in a pulse shape, and when the valve is opened, a control signal of a larger pulse width (W1) is given only to the input terminal a, while a control signal of a smaller pulse width (W2) is given only to the input terminal b when the valve is closed.

Specifically, when opening the aforesaid butterfly valve 34*b*, effective driving is conducted with smaller pulse width by utilizing the torque in a direction in which the return spring 34*e* returns.

Here, when closing the aforesaid butterfly valve 34*b*, a switch control signal of a larger pulse width, which is shown as a valve-opened occasion (a) in FIG. 5, is supplied to the terminal a shown in FIG. 4. Accordingly, on-control is conducted for the transistors Q1 and Q4 by the switch control signal of a larger pulse width shown in FIG. 5 (*a*), thereby rotationally driving the motor 31 in one direction. In this case, a continuity angle of the driving current passing through the motor 31 is larger, therefore the rotational torque of the motor 31 is increased.

When opening the aforesaid butterfly valve 34*b*, a switch control signal of a smaller pulse width, which is shown as a valve-closed occasion (*b*) in FIG. 5, is supplied to the terminal b shown in FIG. 4. Accordingly, on-control is conducted for the transistors Q2 and Q3 by the switch control signal of a smaller pulse width shown in FIG. 5 (*b*), thereby rotationally driving the motor 31 in the reverse direction. In this case, a continuity angle of the driving current passing through the motor 31 is smaller, therefore the rotational torque of the motor 31 is decreased.

According to the above configuration, when opening the aforesaid butterfly valve 34, the driving torque of the butterfly valve 34*b* is increased, and the butterfly valve 34*b* is driven against the momentum in a valve opening direction, given by the aforesaid return spring 34*e*. When closing the aforesaid butterfly valve 34*b*, the driving torque of the butterfly valve 34*b* is decreased, and the butterfly valve 34*b* is driven with the momentum in a valve opening direction, given by the aforesaid return spring 34*e*.

In the configuration shown in FIGS. 1 to 5 in the above, when the engine 1 is actuated, a control signal is supplied to the clutch control circuit 19 from the control unit 15. Following the above, electric current is passed through the electromagnetic plunger 32*c* in the flow control unit 11 from the battery 20, thereby the first clutch disc 32*a* is coupled to the second clutch disc 32*f*. Meanwhile, the temperature information from the temperature detecting element 13 for detecting the temperature of the cooling water flowing out of the engine 1 is supplied to the aforesaid control unit 15 through the converter 14.

Accordingly, when the temperature of the cooling water is risen by driving the engine 1, a control signal of the butterfly valve 34*b* corresponding to the temperature of the cooling water is generated from the control unit 15, and the control signal is supplied to the motor control circuit 18, thereby the motor control circuit 18 drives the DC motor 31 in the flow control unit 11. As a result, the butterfly valve 34*b* is controlled to realize a target preset temperature, thereby cooling the engine to a predetermined temperature.

Here, in the control unit 15, an actual cooling water temperature Tw obtained from the temperature detecting element 13 is compared with a target preset water temperature stored in the control unit 15, specifically, the most suitable cooling water temperature Ts. The difference $\Delta T = Tw - Ts$ is computed, and when the computed result is greater than a predetermined value after a fixed time has passed, specifically, the result is out of the predetermined temperature range, the control unit 15 determines that an abnormality occurs, and generates an abnormality detection output.

The aforesaid control unit 15 is supplied with information regarding the rotational angle of the butterfly valve 34*b* disposed in the flow control unit 11 from the angle sensor 34*g*. In the control unit 15, the temperature information of the cooling water obtained from the temperature detecting element 13 and the information regarding the rotational angle of the butterfly valve 34*b* obtained from the angle sensor 34*g* are always compared and computed.

Accordingly, when the relationship between the rotational angle of the butterfly valve 34*b* obtained from the angle sensor 34*g* and the temperature information of the cooling water obtained from the temperature detecting element 13 differs from predetermined one, the control unit 15 determines that an abnormal condition is established, and generates the abnormality detection output. In this case, a permissible range of the rotational angle of the butterfly valve 34*b* in relation to the cooling water temperature is stored in the control unit 15 in a table form, therefore the control unit 15 determines whether an abnormal condition is established or not from a comparatively simple operation program.

As described in the above, in the control unit 15, in addition to the function of making the computation of $\Delta T = Tw - Ts$ and generating the abnormality detection output based on the result, the abnormality detection output is generated by utilizing the information regarding the rotational angle of the butterfly valve 34*b* obtained from the aforesaid angle sensor 34*g*, thereby reinforcing the fail-safe function.

When an abnormality detection output is generated as described above, the clutch control circuit 19 is actuated based on the abnormality detection output, and the electric current to the electromagnetic plunger 32*c* in the flow control unit 11 is cut off. Therefore the coupling of the first clutch disc 32*a* and the second clutch disc 32*f* is released, and following this, the butterfly valve 34*b* is in a valve opening position by the action of the return spring 34*e*. Accordingly the circulation of the cooling water is promoted, thereby preventing the engine from overheating.

When opening the butterfly valve 34*b* by means of the aforesaid return spring 34*e*, each of the spur gears, pinions, and the like in the speed reduction mechanism 33 is also driven. However, when the clutch mechanism is released, a load for rotating the above components is not so great.

Figure 6:
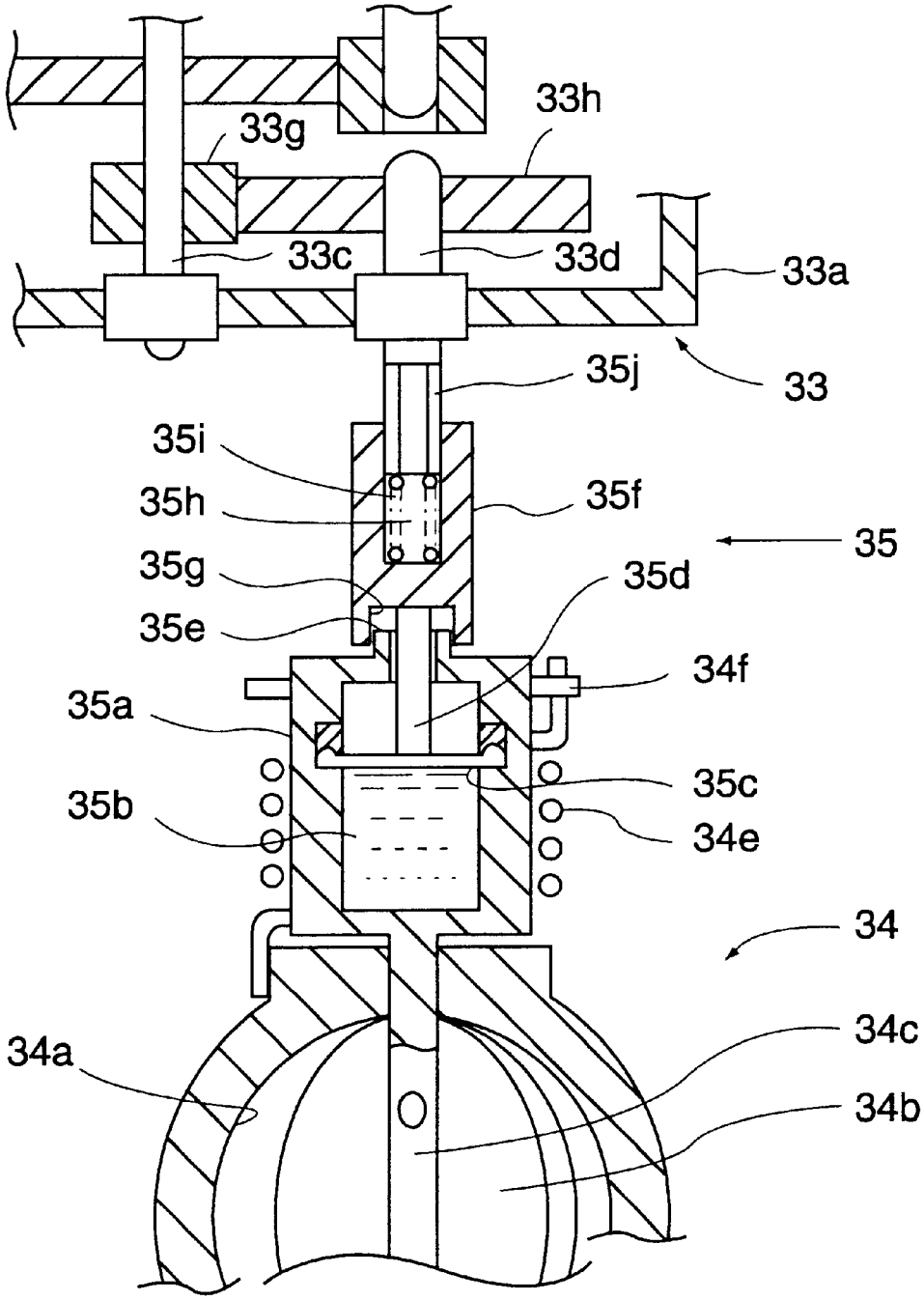
FIG. 6 is a block diagram showing a state in which a cutoff mechanism is disposed in the flow control unit shown in FIG. 2.

Next, FIG. 6 shows the configuration in which a cutoff mechanism controlled by a heat responsive member is further disposed in the flow control unit 11 in FIG. 2. It should be mentioned that the portions same as or corresponding to those in FIG. 2 are represented by the identical numerals, therefore the explanation of them is omitted.

The cut off mechanism 35 is disposed between the speed reduction mechanism 33 and the flow control valve 34. As FIG. 6 shows, a cup-shaped thermo-element 35*a* is integrally coupled to the shaft 34*c* of the butterfly valve 34*b*. Wax 35*b* as the heat responsive member expanding and shrinking depending on the temperature is sealed in the thermo-element 35*a* by means of a bearing plate 35*c*. One end of a piston 35*d* in a rod shape is attached to the aforesaid bearing plate 35*c*, and the other end of the piston 35*d* is protruded outside through a piston guide 35*f* formed on an inside surface of a diameter reduced portion 35*e* formed at a thermo-element 35*a*.

The outer peripheral surface of the diameter reduced portion 35*e* in the aforesaid thermo-element 35*a* has a section which is cut vertically to the axial direction formed in, for example, a hexagon. Meanwhile, 35*f* is a movable body, and shaft holes 35*g* and 35*h* are respectively formed at both end sides in the axial direction by forming the inside surface in, for example, a hexagonal shape.

FIG. 6 shows the state in which the diameter reduced portion 35*e* in the aforesaid thermo-element 35*a* is coupled to the shaft hole 35*g* of the movable body 35*f*. The diameter reduced portion 35*e* and the shaft hole 35*g*, which are formed in a hexagonal shape, are coupled to each other in a direction of rotation so that the movable body 35*f* is slidable in the axial direction. Specifically they are configured in the same way as the configuration in FIG. 3 in which the clutch disc is held.

Meanwhile, a shaft 35*j*, of which section vertically cut relative to the axial direction is formed in, for example, a hexagon, is directly coupled to the output-side rotational shaft 33*d* in the speed reduction mechanism 33, and the shaft 35*j* is fitted into the shaft hole 35*h* of the movable body 35*f*. The shaft 35*j* and the shaft hole 35*h* are configured similarly to the configuration in FIG. 3 in which the clutch disc is held, and they are coupled to each other in a rotational direction while they are slidable in the axial direction.

A coil spring 35*i* is compressedly housed in the shaft hole 35*h*, and gives momentum in a direction to compress the movable body 35*f* to the piston. 35*d* side.

In the configuration shown in FIG. 6, heat is transferred to the thermo-element 35*a* from the cooling water flowing through the cooling medium sluice 34*a* through the shaft 34*c* of the butterfly valve 34*b*. However, when the temperature of the cooling water is in a normal range, the cutoff mechanism 35 maintains the coupling state as shown in FIG. 6, and the butterfly valve 34*b* is opened or closed depending on the temperature of the cooling water.

Here, when the temperature of the cooling water is abnormally increased, the wax 35*b* housed in the thermo-element 35*a* expands, and presses the movable body 35*f* upwards with the piston 35*d*.

Figure 7:
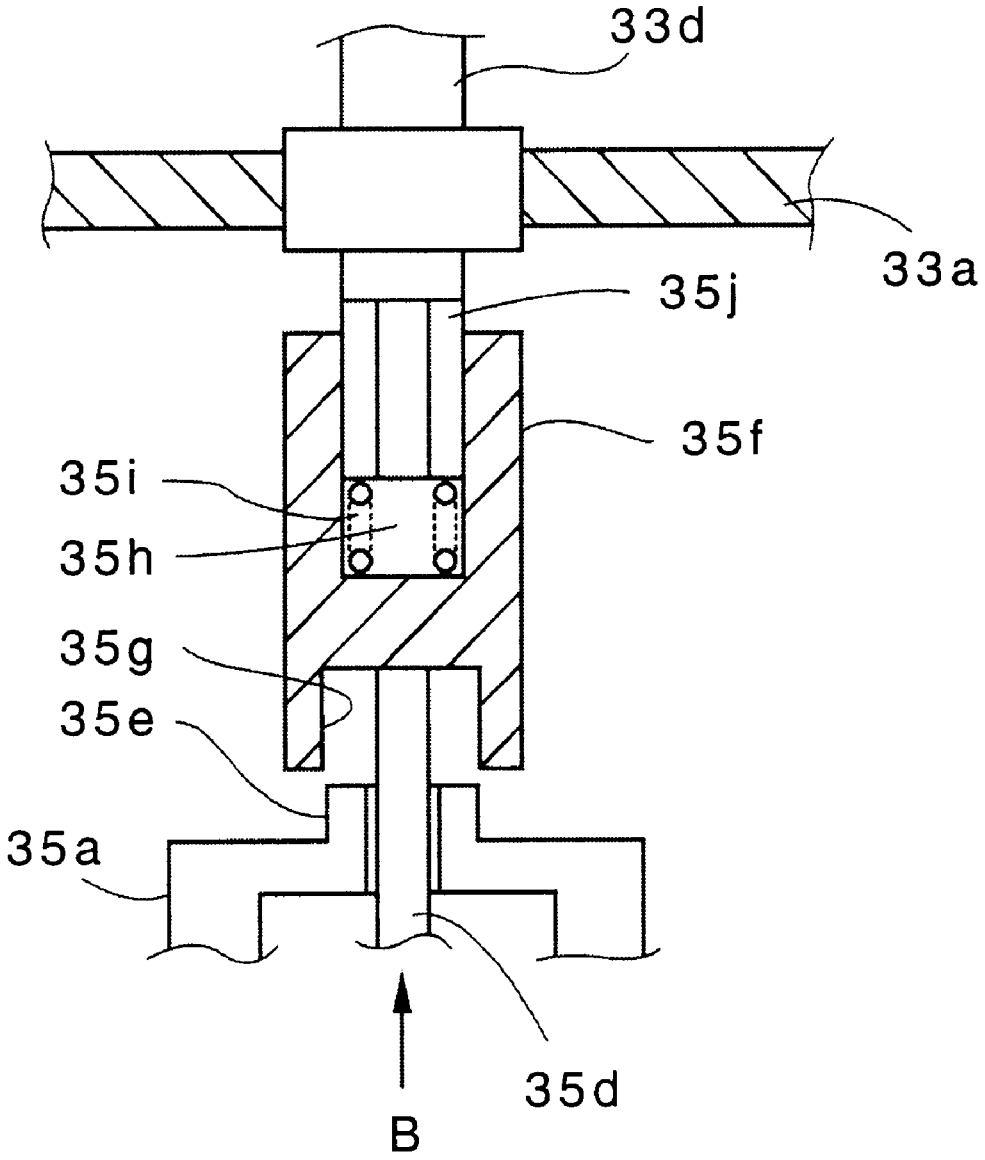
FIG. 7 is a block diagram showing the operating state of the cutoff mechanism shown in FIG. 6.

FIG. 7 shows the state in which the cutoff mechanism 35 is operated when the temperature of the cooling water is abnormally increased. Specifically, as shown in FIG. 7, the movable body 35*f* is pressed upwards by the movement of the piston 35*d* in a direction of an arrow B, thereby cutting off the coupling of the diameter reduced portion 35*e* of the thermo-element 35*a* and the shaft hole 35*g* of the movable body 35*f*.

Accordingly, the butterfly valve 34*b* is opened by the action of the return spring 34*e*, thereby the circulation of the cooling water is promoted, and preventing the engine from overheating.

It should be mentioned that wax is used as the heat responsive member in the aforesaid cutoff mechanism 35, therefore when the temperature of the cooling water returns to be in a normal range, the coupling state shown in FIG. 6 can be established again.

As a result of disposing the aforesaid cutoff mechanism 35, even when a failure hindering the release of the clutch mechanism occurs, or the speed reduction mechanism is locked, the cutoff mechanism 35 is eventually actuated, and the butterfly valve 34*b* is released by the return spring 34*e*, therefore the fail-safe function is further reinforced.

In the above explanation, an example of the case where the rotational angle of the butterfly valve is controlled by detecting the temperature of the cooling water, and in addition to this, the opening degree of the throttle valve, engine speed, or the other parameters can be used.

When the aforesaid clutch mechanism is released, not only the temperature information of the cooling water and the information of the rotational angle of the butterfly valve obtained from the angle sensor are compared and computed, but also the opening degree of the throttle valve, engine speed, or the other parameters can be additionally used in this computation.

In the above, the explanation is made based on the embodiment in which the cooling control system of the present invention is applied to an automobile engine. However, the present invention is not limited to such a specific application, and the similar operational effect can be obtained by applying the present invention to the other internal combustion engines.

As is obvious from the above explanation, according to the cooling control system for an internal combustion engine in accordance with the present invention, the flow control valve such as, for example, a butterfly valve is rotationally controlled by means of the speed reduction mechanism for decelerating the rotation of the motor, and when obtaining an output of the detection of an abnormality in the internal combustion engine, the clutch mechanism is released, thereby the butterfly valve is automatically opened by the return spring, therefore the engine is prevented form overheating.

Further, the clutch mechanism is disposed between the motor and the speed reduction mechanism, thereby load on the clutch mechanism is reduced, and therefore durability is obtained with a small-sized clutch mechanism. Accordingly, the apparatus is reduced in size, and reliability is increased.

Furthermore, the heat responsive cutoff mechanism is disposed between the speed reduction mechanism and the flow control valve, and the cutoff mechanism is eventually actuated to open the flow control valve, therefore the fail-safe function is further reinforced.

What is claimed is:

1. A cooling control system for an internal combustion engine, having a configuration in which a circulating passage for a cooling medium is formed between a fluid conduit formed in an internal combustion engine and a fluid conduit formed at a heat exchanger, and in which heat produced in the internal combustion engine is radiated by said heat exchanger by circulating the cooling medium in said circulating passage, comprising:

a control unit for producing a control signal in response to a detection signal from at least one detecting sensor for detecting the driving condition of the internal combustion engine;

a motor rotationally driven based on a control signal from said control unit;

a speed reduction mechanism for reducing the rotational speed of said motor;

a flow control valve which is opened and closed by the rotational driving force obtained from said speed reduction mechanism, and which controls the flow of the cooling medium in the circulating passage between said internal combustion engine and said heat exchanger;

a return spring for giving momentum to said flow control valve in a valve opening direction; and a clutch mechanism coupling said motor and said speed reduction mechanism, which releases the coupling from said motor and said flow control valve when obtaining the output of the detection of an abnormality in said internal combustion engine.

2. The cooling control system for an internal combustion engine according to claim 1, wherein said flow control valve is composed of a butterfly valve in a flat plate form, which is disposed in the cylindrical passage for the cooling medium, and the angle of which flat surface varies in relation to the direction in which the cooling medium flows.

3. The cooling control system for an internal combustion engine according to claim 1 or claim 2, wherein said clutch mechanism is disposed between a rotational shaft of said motor and said speed reduction mechanism.

4. The cooling control system for an internal combustion engine according to any one of claims 1 or claim 2, wherein said abnormality detection output is generated and based on the temperature of the cooling medium and a target preset temperature stored in said control unit.

5. The cooling control system for an internal combustion engine according to any one of claims 1 or claim 2, wherein said abnormality detection output is generated and based on the relationship between the temperature of the cooling medium and the rotational angle of the flow control valve.

6. The cooling control system for an internal combustion engine according to claim 5, wherein the rotational angle of said flow control valve is obtained from an angle sensor coupled to a shaft supporting said flow control valve.

7. The cooling control system for an internal combustion engine according to any one of claims 1 or claim 2, wherein when driving said flow control valve in a direction to a valve closed position, the driving torque produced by said motor is controlled to be greater compared to the driving torque produced by said motor when driving said flow control valve in a direction to a valve opened position.

8. The cooling control system for an internal combustion engine according to claim 7, wherein said motor is a DC motor, a bridge circuit is composed of first and second switching elements connected in series between a positive terminal and a negative terminal of a power source, and a third and fourth switching elements connected in series between the positive terminal and the negative terminal, a pair of driving current input terminals of said DC motor are respectively connected to a junction of said first and second switching elements and a junction of said third and fourth switching elements between the junctions, and a pulse width added to a control electrode terminal of said first and fourth switching elements has a pulse width different from that added to a control electrode terminal of said second and third switching elements.

9. The cooling control system for an internal combustion engine according to any one of claims 1 or claim 2, further comprising a heat responsive member which expands and shrinks depending on the temperature of the cooling medium to compose a cutoff mechanism for releasing the coupling of the shaft for supporting said flow control valve and said speed reduction mechanism by the expanding action of said heat responsive member, so that said cutoff mechanism allows the flow control valve to be in a valve opened position by means of said return spring.

* * * * *